US012650224B2

(12) United States Patent
Waldner et al.

(10) Patent No.: US 12,650,224 B2
(45) Date of Patent: Jun. 9, 2026

(54) WATER-COOLED GRATE BLOCK FOR AN INCINERATOR

(71) Applicant: HITACHI ZOSEN INOVA AG, Zürich (CH)

(72) Inventors: Maurice Henri Waldner, Wettingen (CH); Werner Brennwald, Neftenbach (CH)

(73) Assignee: KANADEVIA INOVA AG, Zürich (CH)

( * ) Notice: Subject to any disclaimer, the term of this patent is extended or adjusted under 35 U.S.C. 154(b) by 581 days.

(21) Appl. No.: 18/025,418

(22) PCT Filed: Sep. 9, 2021

(86) PCT No.: PCT/EP2021/074784
§ 371 (c)(1),
(2) Date: Mar. 9, 2023

(87) PCT Pub. No.: WO2022/053550
PCT Pub. Date: Mar. 17, 2022

(65) Prior Publication Data

US 2023/0332769 A1 Oct. 19, 2023

(51) Int. Cl.
*F23G 5/00* (2006.01)
*F23G 5/44* (2006.01)
*F23H 11/12* (2006.01)

(52) U.S. Cl.
CPC ..... *F23G 5/002* (2013.01); *F23G 5/444* (2013.01); *F23H 11/12* (2013.01); *F23G 2203/101* (2013.01); *F23H 2700/009* (2013.01)

(58) Field of Classification Search
CPC .. F23H 11/12; F23H 2900/03021; F23H 7/14; F23H 3/02; F23G 2203/101
See application file for complete search history.

(56) References Cited

U.S. PATENT DOCUMENTS 5,636,581 A 6/1997 Kleen et al.
5,673,636 A * 10/1997 Stiefel ..... F23H 3/02 110/101 A (Continued)

FOREIGN PATENT DOCUMENTS

DE 10 2015 101 356 A1 8/2016
EP 0 989 364 A1 3/2000

(Continued)

OTHER PUBLICATIONS

Jun. 17, 2025 Office Action issued in Japanese Patent Application No. 2023-515636.

(Continued)

*Primary Examiner* — David J Laux
(74) *Attorney, Agent, or Firm* — Oliff PLC

(57) ABSTRACT

A cooled grate block as part of a grate for a system for thermally treating waste, including: a block body in the form of a cast part having an outer supporting face for the waste to be treated; a flat cavity situated directly below the supporting face, for receiving a cooling fluid; a fluid feed line and a fluid discharge line, which are connected to the cavity; at least one deflection element, which is arranged in the cavity to direct a cooling fluid within the cavity from the fluid feed line to the fluid discharge line; and a valve element situated in the end region of the cavity, for distributing the cooling fluid fed into the cavity through the fluid feed line.

16 Claims, 7 Drawing Sheets

(56) References Cited

U.S. PATENT DOCUMENTS

| | | | | |
|---|---|---|---|---|
| 2001/0003266 | A1* | 6/2001 | Koch | F23H 17/12 110/328 |
| 2017/0261205 | A1* | 9/2017 | Brennwald | F23H 7/04 |
| 2018/0142889 | A1* | 5/2018 | Dunnu | F23H 17/12 |

FOREIGN PATENT DOCUMENTS

| | | | |
|---|---|---|---|
| EP | 1 191 282 | A1 | 3/2002 |
| EP | 0 811 803 | B1 | 7/2005 |
| EP | 1 315 936 | B1 | 5/2006 |
| EP | 1 760 400 | B1 | 1/2009 |
| JP | -02-106613 | A | 4/1990 |
| JP | 2000-121013 | A | 4/2000 |
| JP | 2002-147736 | A | 5/2002 |
| KR | 10-1560714 | B1 | 10/2015 |
| KR | 10-1701720 | B1 | 2/2017 |
| KR | 10-2110167 | B1 | 5/2020 |

OTHER PUBLICATIONS

Dec. 1, 2021 International Search Report issued in International Patent Application No. PCT/EP2021/074784.
Dec. 1, 2021 Written Opinion issued in International Patent Application No. PCT/EP2021/074784.
English Translation of Jan. 27, 2026 Office Action issued in JP Patent Application No. 2023-515636.

* cited by examiner

WATER-COOLED GRATE BLOCK FOR AN INCINERATOR

Combustion grates for industrial combustion of waste have been known to the person skilled in the art for some time. Such combustion grates may be, for example, in the form of push-in combustion grates which comprise movable components in order to carry out raking travel actions. In this case, the combustion material is conveyed in the transport direction from an inlet-side end of the combustion grate toward an outlet-side end and combusted during this action. In order to supply the combustion grate with the oxygen which is necessary for the combustion, corresponding air supply lines which extend through the combustion grate and via which the air—also called primary air—is introduced are provided.

The so-called stepped grate constitutes a combustion grate which is often used. This grate comprises grate blocks which are arranged beside each other and which each form a grate block row. The grate block rows are arranged one above the other in a step-like manner in this case, wherein, in the case of so-called feed grates, the front end, when viewed in the pushing direction, of a grate block is positioned on a support face of the grate block (underneath) which is adjacent in the transport direction and which is moved on this support face with a corresponding pushing movement.

As a result of the combustion material which is conveyed over the grate blocks, the blocks are generally exposed to a relatively high wear. In the front region of a respective grate block, the combustion material is ejected from the support face via a corresponding ejection edge (also referred to as a projection) onto the support face of the subsequent or downwardly adjacent grate block. The mechanical abrasion by the combustion material is particularly high in this case precisely in this front end region of the support face.

As a result of the high temperatures during the combustion or in the combustion chamber, the grate blocks are further exposed to a thermal loading which is very powerful. During normal operation of the combustion grate, this thermal loading is particularly high in the region of the support face, although the combustion material which is located on the grate block acts in an insulating manner up to a specific degree. Temperature peaks and associated loading peaks occur particularly when the combustion material is distributed in a non-uniform manner on the combustion grate and consequently forms only a thin insulating layer at a small number of locations, or if this insulating layer is completely absent. The thermal loading promotes the erosion as a result of abrasion and chemical reactions which occur at the support face and which further damage the support face. This all ultimately leads to a reduction of the service-life of the grate block.

In order to reduce the thermal loading, the grate rods are normally cooled from below with a coolant or cooling fluid, that is to say, at the side of the combustion grate opposite the combustion. Generally, water or air is used as a coolant, for which reason air-cooled or water-cooled grate blocks are also often spoken about. The type of cooling or the coolant supply is the subject-matter of a large number of patent applications or patents.

EP 1 760 400 B1 discloses a water-cooled grate element made of cast steel with redirection members which form meandering water guiding channels. The disadvantage of such a water guide is that the cooling power is impaired directly above the redirection members because the cooling fluid does not have any contact with the upper wall at that location and consequently cannot transport away the heat which is generated by the combustion. Consequently, a combustion face with so-called "thermal hot spots" is produced at these locations.

DE 10 2015 101 356 A1 and EP 1 315 936 B1 disclose a grate rod having a cooling coil which extends parallel with the combustion surface and the front wall.

EP 0 811 803 B1 discloses cooled grate blocks, in which the cooling lines extend at right-angles relative to the advance direction and which are redirected outside the grate blocks by means of brackets.

During the cooling by means of the known cooling channels or cooling lines, far from the whole region of the combustion surface is covered, which promotes the production of the above-mentioned "thermal hot spots".

In order to achieve a cooling power which is as high as possible, the maximization of the surface which is available for the heat exchange is of primary importance. In the case of fluid coolants, a flow which is as uniform as possible of the coolant is further of central importance. Otherwise, turbulence and bubble formation may occur in the cooling lines, whereby the cooling power of the grate blocks is decreased.

Therefore, an object of the invention is to overcome the disadvantages of the prior art and to provide a grate block, in which the cooled face is maximized proportionally and at the same time the occurrence of turbulence in the coolant stream is reduced so that the cooling power can be further improved.

This object is achieved according to the invention with a grate block according to claim 1 and a grate according to claim 16. Preferred embodiments of the invention are set out in the dependent claims.

The invention relates to a cooled grate block as part of a grate for an installation for thermally processing waste. In this grate, the grate blocks are usually arranged in a step-like manner one above the other and configured in such a manner that they rearrange and convey the combustion material during the combustion by means of pushing movements which are carried out relative to each other. In this case, the grate block according to the invention comprises a block member which is in the form of a cast component and which has an upper wall. The upper wall forms an external support face which extends at least partially parallel with a longitudinal axis L of the block member for the waste which is intended to be processed. Furthermore, the grate block according to the invention comprises a planar hollow space which is arranged directly under the support face for receiving a cooling fluid. In this case, the planar hollow space is delimited at the upper side by the upper wall, at the front by a front wall, at the bottom by a base, at the rear by a rear wall and laterally by side walls, wherein the base is at least partially formed by a base plate. Furthermore, the grate block according to the invention comprises a fluid supply line and a fluid discharge line which are both connected to the hollow space and at least one redirection element which is arranged in the hollow space in order to redirect the cooling fluid in the hollow space from the fluid supply line to the fluid discharge line. In a front region of the hollow space of the grate block according to the invention, a distributor element is further located in order to distribute the cooling fluid which is introduced through the fluid supply line into the hollow space.

Preferably, the at least one redirecting element is located in the hollow space in a rear region of the rear wall.

According to the present invention, grate blocks which are arranged in the manner of steps of an ascending and descending staircase on a grate are defined as grate blocks which are located one above the other in a step-like manner.

The term "pushing movements which can be carried out relative to each other" is intended to be understood to be pushing movements which can be carried out parallel with the longitudinal axis of the grate which comprises grate blocks. The movement direction consequently extends parallel with the inclination or gradient of the grate in a step-like grate.

The "longitudinal axis of the grate block" is intended in this case to refer to an axis which extends parallel with the axis of the step-like grate—that is to say, from the front wall to the rear wall of the grate block—and consequently extends parallel with the pushing direction of the waste which is intended to be processed. If the grate block is orientated so that the longitudinal axis and a width axis extending at right-angles relative thereto are arranged in the horizontal plane, the front wall is then preferably arranged at least approximately in the vertical plane.

According to the present application, a face which is arranged at the external upper side, that is to say, at the opposite side of the hollow space, and on which the waste (combustion material) which is provided for thermal processing is positioned is understood to be the "support face". As mentioned in the introduction, this support face is exposed, as known, to an increased thermal loading in combustion installations and is susceptible to erosion and combustion products becoming baked on.

According to the present application, a stream of cooling fluid—preferably water—which is directed through the hollow space from the fluid supply line to the fluid discharge line or vice versa is defined as a fluid stream or cooling fluid stream.

According to the present invention, the term "planar hollow space" is intended to be understood so that the hollow space has a shape, the extent of which is greater in a horizontal direction (length and width) than in a vertical direction (height). Preferably, the hollow space has at least partially a parallelepipedal shape, with the greatest surface parallel with the support face. In particular, no pipelines which transport the fluid from the fluid supply line to the fluid discharge line are provided in the planar hollow space.

Lines which are suitable for guiding cooling fluid into and out of the hollow space are understood to be the fluid supply line and fluid discharge line below. In this instance, explicit mention may be made of the possibility that the fluid steam can flow in both directions, that is to say, can be supplied and discharged through both lines alternately.

According to the present invention, the term "front side" or "at the front side" is intended to be understood to mean that the side in the region of the front wall is involved.

According to the present invention, an obstacle which is constructed in such a manner that it allows a limitation and/or change of direction of the flow and therefore a distribution of the incoming cooling fluid is defined as a distributor element. The distribution of the cooling fluid is preferably carried out upstream or in the region of the introduction of the cooling fluid into the planar hollow space. In this case, the distributor element may be in different forms, as will be explained in greater detail below.

In comparison with the prior art, the grate block according to the invention has the advantage that the cooling fluid stream which flows in the hollow space can be uniformly distributed over the width of the hollow space as a result of the distributor element. This means that the generation of cooling fluid turbulence and the formation of foam can be reduced or even completely prevented, which leads to an increased cooling power of the grate block. The increased cooling power affords the advantage that the thermal loading and wear of the grate blocks is reduced and furthermore fewer burnt-out materials are baked onto the grate blocks, whereby they have to be cleaned and maintained less often. Finally, this leads to fewer maintenance operations having to be carried out and consequently the combustion installation being able to be operated economically more productively.

As described above, the planar hollow space generally does not have any pipelines which could impair a uniform distribution of the cooling fluid in the hollow space and which would therefore reduce the cooling power.

Preferably, the distributor element extends at least partially along a width axis which extends at least approximately parallel with the front wall. This allows a regular distribution of the cooling fluid over the width of the planar hollow space (or a compartment of the planar hollow space).

In a preferred embodiment of the grate block, the planar hollow space is connected to a front chamber. This chamber preferably extends substantially parallel with the front wall and preferably at least over half of the length of the front wall. It is preferably constructed in such a manner that the cooling fluid supply to the planar hollow space or the cooling fluid discharge from the planar hollow space is brought about by the chamber. Such an embodiment is illustrated in the appended FIG. 2.

The planar hollow space and the chamber are preferably connected to each other via a plurality of supply openings. This preferably allows a preliminary distribution of the cooling fluid before it meets the distributor element and consequently also contributes to a better distribution of the cooling fluid in the planar hollow space.

Similarly, the introduction of the cooling fluid through the chamber into the hollow space also allows the front wall, which is often also referred to as the projection, to be cooled. Although the front wall is usually exposed to a slightly smaller thermal loading than the support face, its cooling contributes to the prevention of flue ash or other combustion products from becoming baked on.

In a preferred embodiment of the grate block, the planar hollow space has a dividing wall which extends from the base to the upper wall. This dividing wall preferably extends from the front wall in the direction of the rear wall of the hollow space and preferably forms a passage in the region of the rear wall so that the hollow space is subdivided into two compartments which are connected in a fluid-conducting manner.

As a result of the dividing wall, the fluid stream consequently preferably flows through a first compartment of the hollow space which extends from the front wall along the longitudinal axis over a desired length of the hollow space. In the region of the rear wall, the fluid stream is directed by the passage, whereby it is redirected and flows back through a second compartment which is adjacent to the first compartment in the opposite direction, that is to say, in the direction toward the front wall. As a result of the dividing wall, the rear regions of the hollow space are also sufficiently supplied with fresh cooling fluid so that the cooling power is also ensured in these regions.

It has been found that with known water-cooled grate blocks air is conveyed into the hollow space by the cooling fluid stream and can remain there as air inclusions at most in corners or at poorly accessible locations. As a result of the smaller density of air in comparison with water, any air inclusions preferably collect at the upper side of the cooling chamber and, since the thermal conductivity of air is substantially less than that of water, such air inclusions lead to a reduced cooling power of the grate block. Therefore, the grate block according to the invention preferably comprises in the case of a fluid cooling fluid at least one ventilation opening for ventilating the hollow space or the compartments in order to convey any such air inclusions out of the grate block. At the same time, the ventilation of the hollow space or the compartments prevents air from also being carried with the cooling fluid over the entire length of the fluid stream.

If the hollow space is subdivided into compartments by means of a dividing wall, the ventilation opening is preferably constructed in the dividing wall, preferably in the region of the front wall, in order to allow ventilation of the hollow space or the compartments which are produced by the dividing wall.

Preferably, the ventilation opening has a diameter of from 2 to 12 mm, particularly preferably from 4 to 5 mm. This size allows the grate block including the ventilation opening to be able to be produced with the known casting methods.

In a preferred embodiment of the grate block, the dividing wall extends at least approximately parallel with one of the side walls and is preferably arranged centrally in the hollow space. In this embodiment, consequently, the dividing wall divides the planar hollow space into two compartments which are at least approximately of the same size. Thus, it is ensured that the fluid stream flows uniformly through the hollow space or through the compartments and is not accelerated or decelerated as a result of a change of the hollow space or compartment geometry. Consequently, turbulence is prevented from being produced by the fluid stream being accelerated or decelerated inside the hollow space or the compartments.

Preferably, the fluid supply line and the fluid discharge line are connected in the region of the front wall to the planar hollow space. As a result of the connection of the fluid supply line and the fluid discharge line to the hollow space in the front or end region, the largest possible space becomes free under the block member.

Preferably, both the fluid supply line and the fluid discharge line have an internal diameter of from 20 to 32 mm, preferably from 22 to 30 mm and particularly preferably from 26 to 28 mm. Line diameters of this size have the advantage that a flow speed at which the flow automatically ventilates the entire line system of the grate block including the hollow space is produced for the usual cooling fluid circulation quantity. Depending on the embodiment, the distributor element can extend over the entire width of the hollow space or also over only portions thereof.

In a preferred embodiment of the grate block, the distributor element is constructed in such a manner that it only allows a limited throughflow of cooling fluid past the distributor element—or over it—in order to allow a uniform distribution of the cooling fluid inside the hollow space. This uniform distribution of the cooling fluid stream allows an increased cooling power since turbulence of the cooling fluid and foam formation is reduced or prevented.

In a specific preferred embodiment, the cooling fluid which flows through the fluid supply line initially meets the distributor element, whereby turbulence is calmed. In this case, the water can preferably flow through openings in the distributor element (if present) or over or around it.

In a preferred embodiment of the grate block, the distributor element is in the form of a baffle plate or a baffle sheet. Other preferred embodiments comprise a distributor element which is in the form of a boss, aperture, perforated plate or transverse bar. In this case, the longitudinal axis of the distributor element preferably extends approximately parallel with the front wall.

If the distributor element is in the form of a boss, this means that the distributor element has a hill-like or embankment-like cross section in the width direction, that is to say, parallel with the front wall. Consequently, the cooling fluid flows perpendicularly to the front wall and counter to the movement direction of the combustion material over the distributor element.

In the case of a perforated plate, this is intended to be understood to mean that the distributor element comprises a plate which has a front face which faces the fluid stream and which has at least one opening, through which the fluid stream is directed.

In the case of a transverse bar, this is intended to be understood to mean that the distributor element forms a wall or a bar, over or under which the cooling fluid can flow. Preferably, the bar extends along the entire width of the grate block in this case and at least approximately parallel with the front wall.

As mentioned above, the distributor element allows a uniform distribution of the cooling fluid stream over the entire width of the hollow space as far as possible and, in the event that the hollow space has compartments, over the width of the compartments. This uniform distribution of the cooling fluid stream allows an increased cooling power because turbulence of the cooling fluid and foam formation can be reduced or prevented. The distribution is generally carried out in the region of the introduction of the cooling fluid into the hollow space and can be achieved by means of a distributor element which is simply configured in terms of shape. The distributor element can preferably be cast simultaneously or be subsequently inserted as a separate component.

Furthermore, the distributor element preferably extends in a width direction at least over the width of an opening cross section of the fluid supply line.

In a preferred embodiment of the grate block, the distributor element is connected to the base and/or at the upper side to the upper wall. If the distributor element is in the form of a transverse bar, it preferably forms with the upper wall and/or the base a slot-like fluid passage opening. In a particularly preferable manner, the fluid passage opening is constructed between an upper edge of the transverse bar and the upper wall. The fluid passage opening preferably has in this case a clear width of from 1 to 15 mm, preferably from 2 to 10 mm and particularly preferably from 3 to 6 mm.

With respect to a uniform distribution of the cooling fluid stream which is introduced into the hollow space, the above-described embodiment of the distributor element as a transverse bar with the above properties has been found to be particularly effective.

In another preferred embodiment of the grate block, the distributor element is located in the opening region of the at least one supply line. It has been found that turbulence in the cooling fluid occurs particularly often during introduction into the hollow space—that is to say, in the opening region of the supply line. Since the thermal loading in the front region of the grate block is particularly high, a cooling power which is reduced by air inclusions has at that location a two-fold negative effect. In an arrangement of the distributor element in the opening region of the supply line, a rapid calming is achieved during the introduction of the cooling fluid into the hollow space.

The distributor element preferably comprises a boss-like, embankment-like or hill-like obstacle which limits or redirects the flow of the cooling fluid out of the fluid supply line. In this case, the distributor element preferably has a height of from 5 to 15 mm, particularly preferably from 8 to 12 mm and most particularly preferably of 10 mm, and a width of preferably from 20 to 40 mm, particularly preferably from 25 to 35 mm and most particularly preferably of 30 mm.

The combination of the boss-like, embankment-like or hill-like distributor element which is located in the opening region of the supply line has been found to be extremely effective during the distribution of the cooling fluid stream in the hollow space. Furthermore, the production of such a distributor element with the known casting methods is easy to carry out and is therefore preferred.

In the event that the distributor element is in the form of a transverse bar, the distributor element preferably has a face which is at least 50% of the vertical cross sectional surface area of the hollow space or the respective compartment.

The transverse bar preferably has a thickness of from 2 mm to 10 mm and a length of from 50 mm to 250 mm.

In the event that the distributor element is in the form of a transverse bar, it preferably extends over at least 50%, preferably over at least 75% and particularly preferably over at least 90% of the width of the hollow space or the respective compartment.

In a preferred embodiment of the grate block, the upper wall and/or the front wall has at least one air supply opening. This air supply opening allows air to be additionally conveyed into the combustion chamber in order to ensure optimum combustion. From the upper wall, the air supply opening can expand concentrically in a downward direction (in the manner of a volcano), whereby the air supply opening is prevented from becoming blocked with thermally processed waste. Such volcano-like air supply openings are preferably arranged in the upper wall. Furthermore, they preferably have an oval opening cross section with a diameter of from 33 to 45 mm to from 4 to 12 mm. Furthermore, they preferably expand in the direction of the base plate at an angle of from 18 to 22° up to a smaller diameter of from 22 to 28 mm.

The block member is preferably produced integrally as a cast component and preferably also comprises a piece of the base. The base plate which preferably at least partially forms the base is preferably welded to the block member and thus delimits the hollow space. This means that a portion of the base is preferably in the form of an integral component of the block member and the hollow space is further at least partially delimited at the bottom by the base plate. This allows a simple production of the hollow space since the cast component can be cast in one step and the hollow space can subsequently be formed by securing, preferably by welding, the base plate. Such production of the block member is particularly favorable and makes the block member particularly durable and low-maintenance. Naturally, the person skilled in the art is aware that the cast component can be still further processed before the base plate is secured, for example, by using an abrasive.

In a preferred embodiment of the grate block, the hollow space extends over at least ⅔ of the length of the support face. Furthermore, the hollow space preferably extends over at least h of the width of the support face. Thus, it is ensured that as large an area as possible is available for the heat exchange.

In this case, the hollow space should preferably cover at least the support face for the waste which is intended to be processed so that a thermally stressed, non-cooled area of the block member is not produced.

Preferably, the cooling fluid has during operation of the grate block, that is to say, during the combustion of high-calorific waste, such as domestic refuse or commercial refuse, a temperature of from 20 to 140° C., whereby operating temperatures for the grate block of up to 250° C. are reached. Furthermore, preferably water from a closed circuit is used as the cooling fluid in order to prevent the introduction of oxygen and therefore the production of corrosion. If water is used as the cooling fluid, it preferably does not have or has only a small proportion of lime.

The invention further relates to a grate comprising a plurality of the above-described grate blocks.

The invention is explained in greater detail below with reference to a number of embodiments illustrated in the Figures. If alternative embodiments differ only in terms of individual features, the same reference numerals have been used for the features remaining the same. In the purely schematic drawings.

Figure 1:
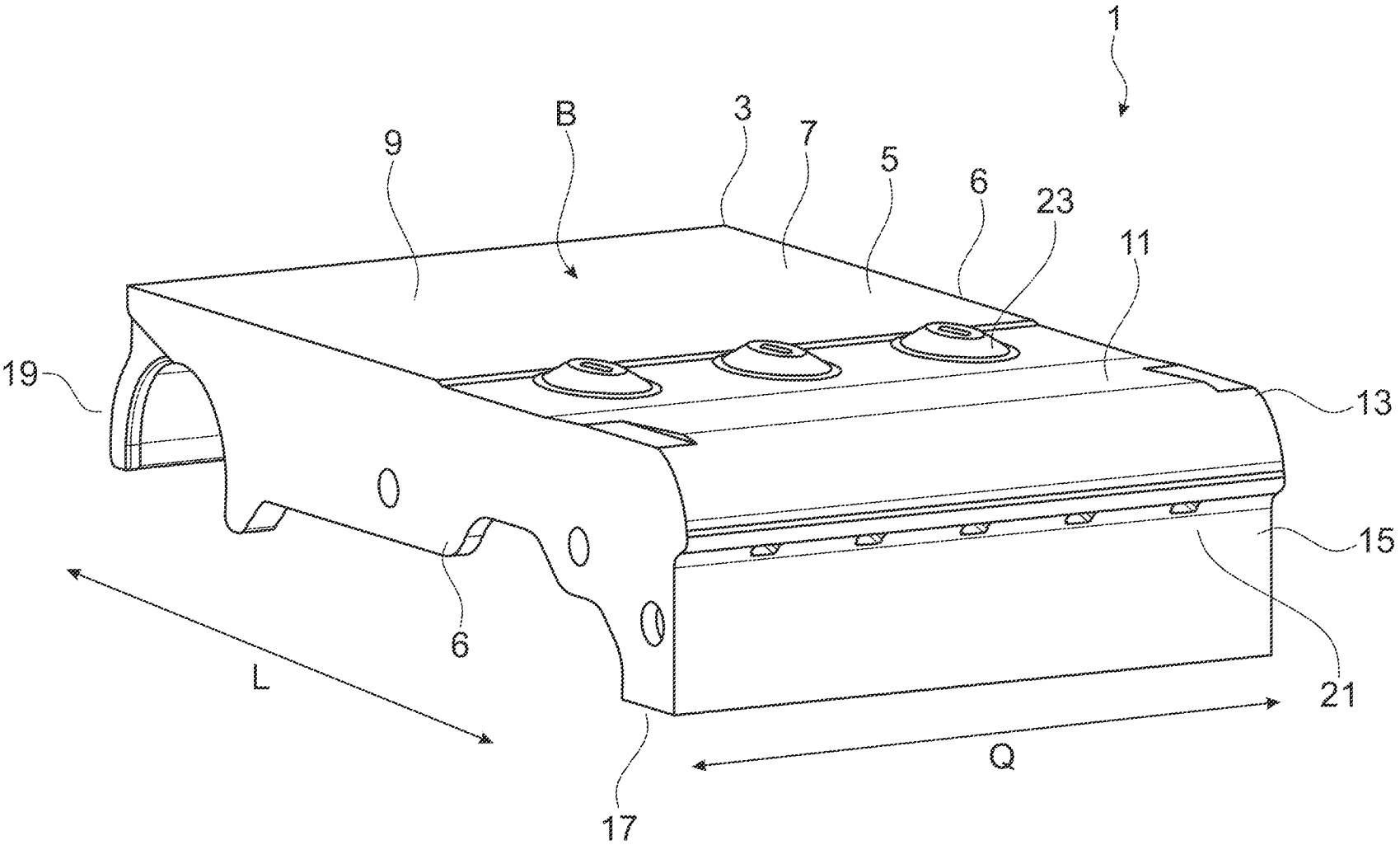
FIG. 1 shows a perspective view of an embodiment of a grate block according to the invention.
Figure 4A:
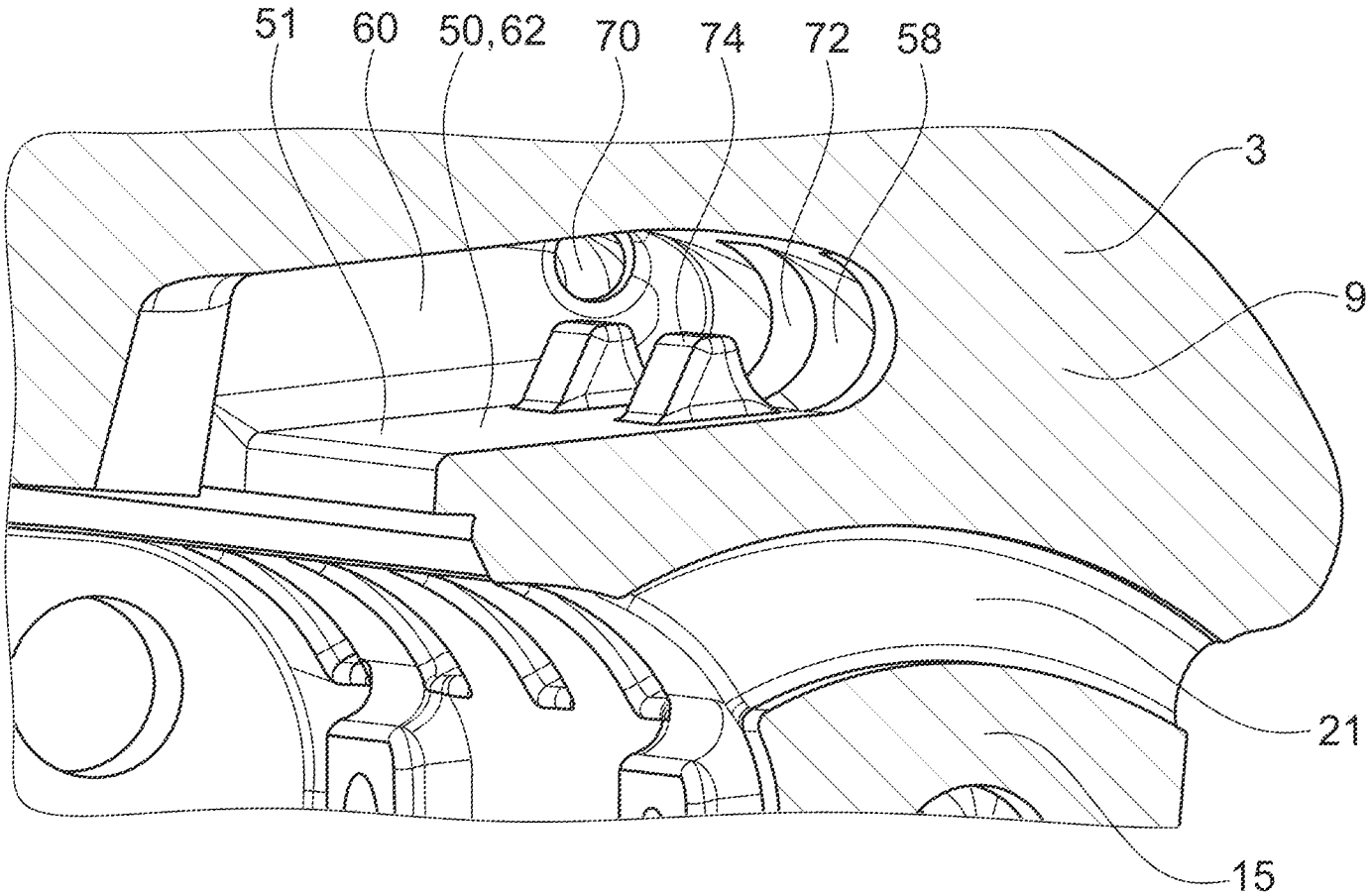
Figure 4B:
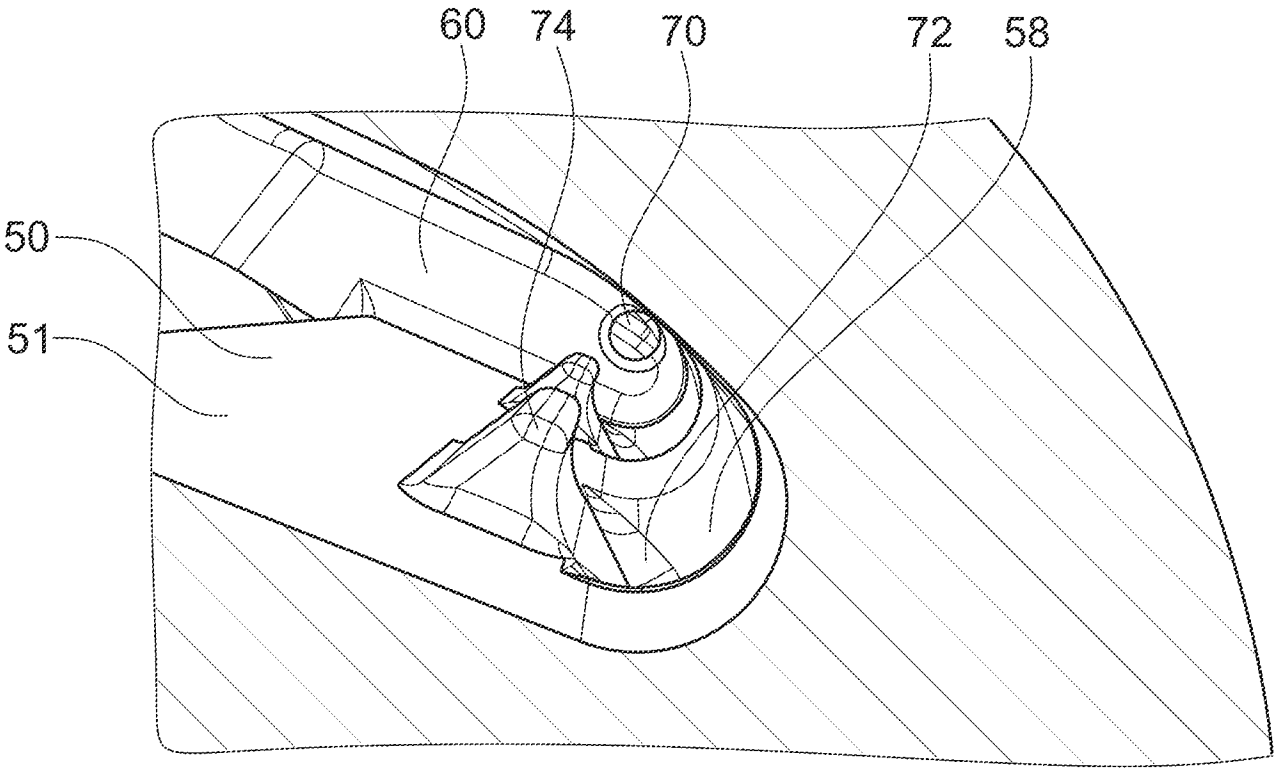
Figure 5:
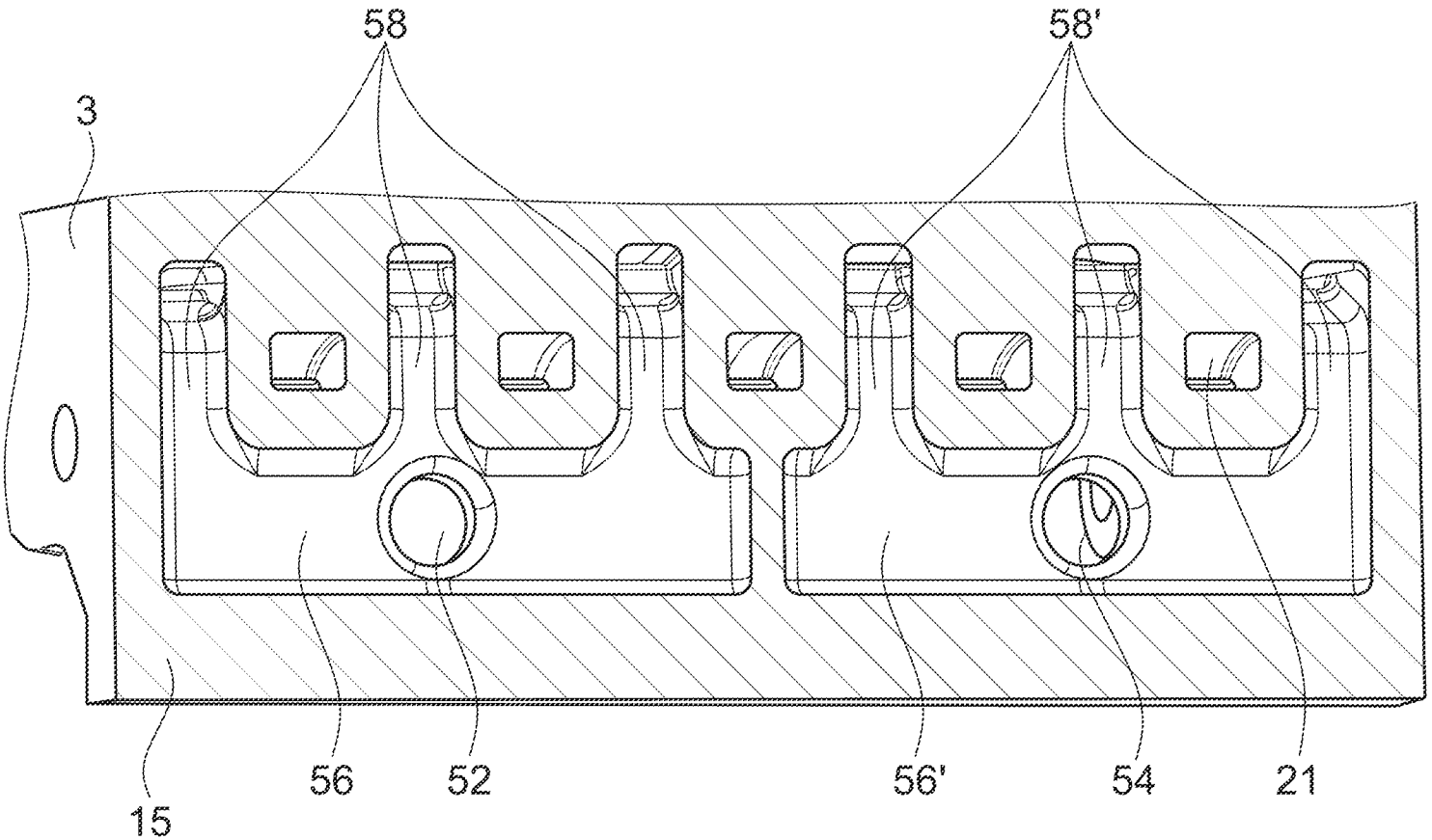
Figure 6:
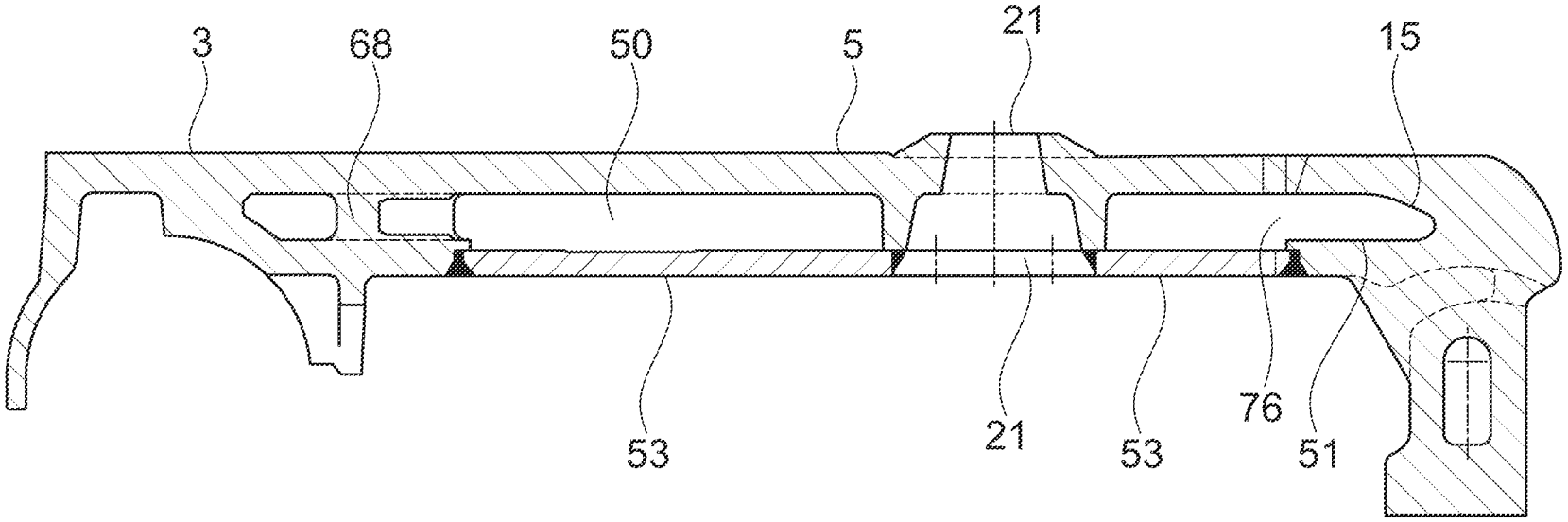

FIG. 4*a* shows a longitudinal section along the longitudinal axis L through an embodiment of a front region of the block member from FIG. 1;

FIG. 4*b* shows a longitudinal section along the longitudinal axis L through an embodiment of a front region of the block member from FIG. 1;

FIG. 5 shows a cross section along the width axis Q through an embodiment of a front region of the block member from FIG. 1; and FIG. 6 shows a longitudinal section along the longitudinal axis L through an embodiment of the block member from FIG. 1.

The grate block 1 according to the invention which is depicted in FIG. 1 serves to thermally process waste as a combustion material (not illustrated) which is moved or conveyed over the grate in a movement direction B. The grate block 1 comprises a block member 3 having an upper wall 5 and side walls 6. The upper wall 5 comprises an external support face 7 which extends along a longitudinal axis L of the grate block 1 from a rear region 9 of the block member 3 in the direction of a front region 11 of the block member 3. The block member 3 further comprises in the front region 11 a rounded overhang 13 (referred to as a projection below) which connects the front region 11 to a front wall 15.

In a grate arrangement which is not shown and in which a plurality of individual grate blocks 1 are arranged one above the other in a step-like manner, a sliding face 17 which adjoins the front wall 15 is positioned on the support face 7 of an additional grate block (not illustrated). By means of pushing movements which are carried out relative to each other, thermally processed waste is conveyed in the movement direction B. To this end, the sliding faces 17 slide on the support faces 7 of the grate blocks which are arranged underneath (not illustrated). The relative pushing movements are carried out along the longitudinal axis L and driven by a drive apparatus which is not illustrated and which transmits the movement via a bracket 19 to the block member. In such a grate arrangement, a plurality of grate blocks can be located beside each other so that the side walls 6 of the grate block 1 adjoin the side walls of other grate blocks.

The block member 3 comprises air supply openings 21, 23 which are arranged in the front wall 15 and the upper wall 5 and by which the thermally processed waste can be supplied with air in order to promote the combustion. Embodiments which do not have any air supply openings are also conceivable, but not set out here. The air supply openings 23 in the upper wall 5 are preferably in the form of downwardly expanding passages so that portions of the waste to be processed do not become jammed in the opening during possible introduction.

Figure 2:
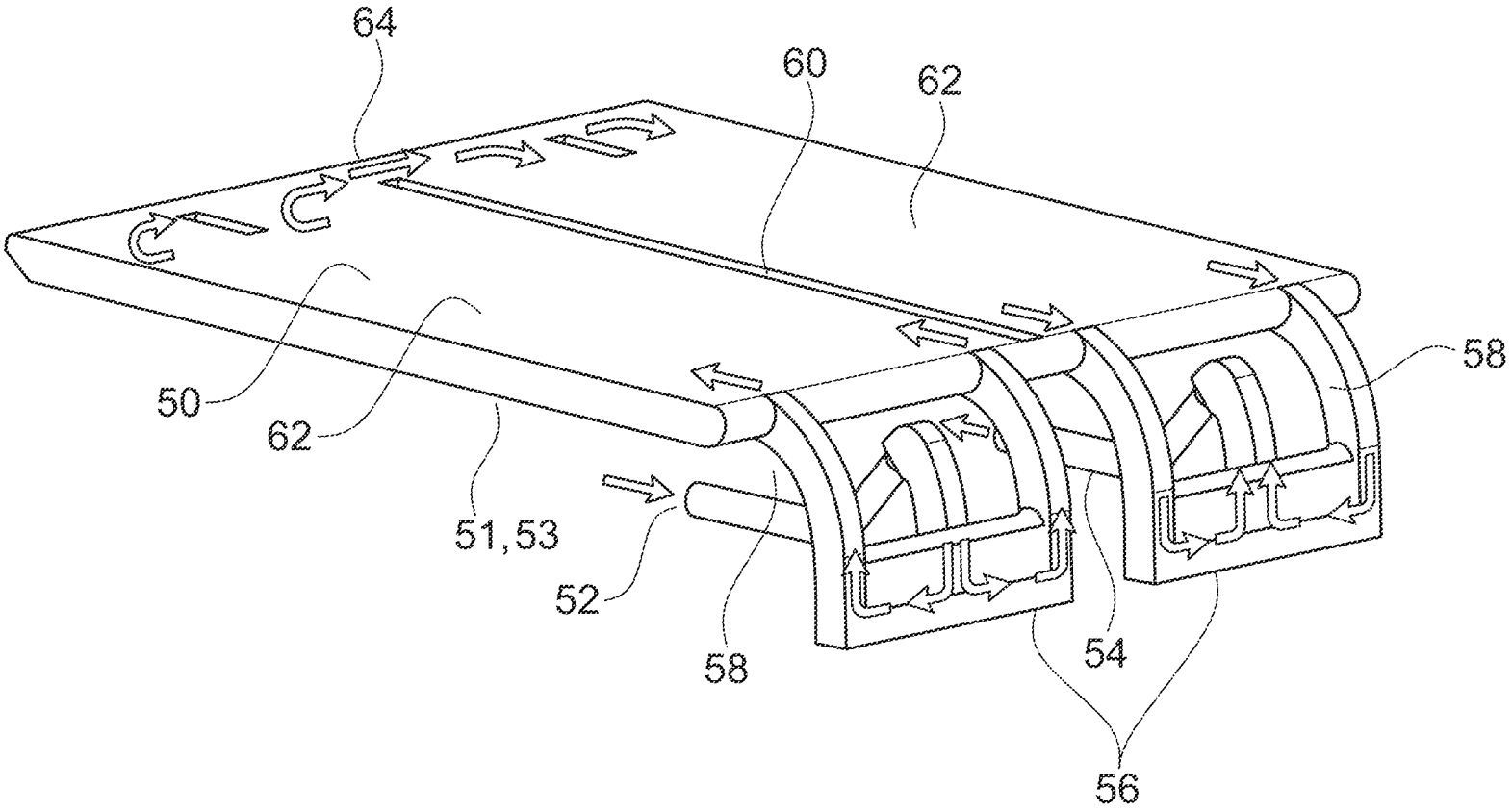
FIG. 2 shows a perspective view of an embodiment of a planar hollow space.

The block member 3 further comprises a planar hollow space 50. As illustrated in FIG. 2, the planar hollow space 50 is delimited opposite the upper wall 5 of the block member 3 by a base 51 and a base plate 53. In this case, the hollow space 50 further comprises a fluid supply line 52 and a fluid discharge line 54 which are connected to a chamber 56. The chamber 56 extends substantially parallel with the front wall 15 (FIG. 1) and is connected to the planar hollow space 50 via supply openings 58. The planar hollow space 50 further comprises a dividing wall 60 which extends from the front wall (reference numeral 15 in FIG. 1) in the direction of a rear wall 68 (FIG. 3) and which forms a passage 64 so that the hollow space 50 is subdivided into two compartments 62.

Figure 3:
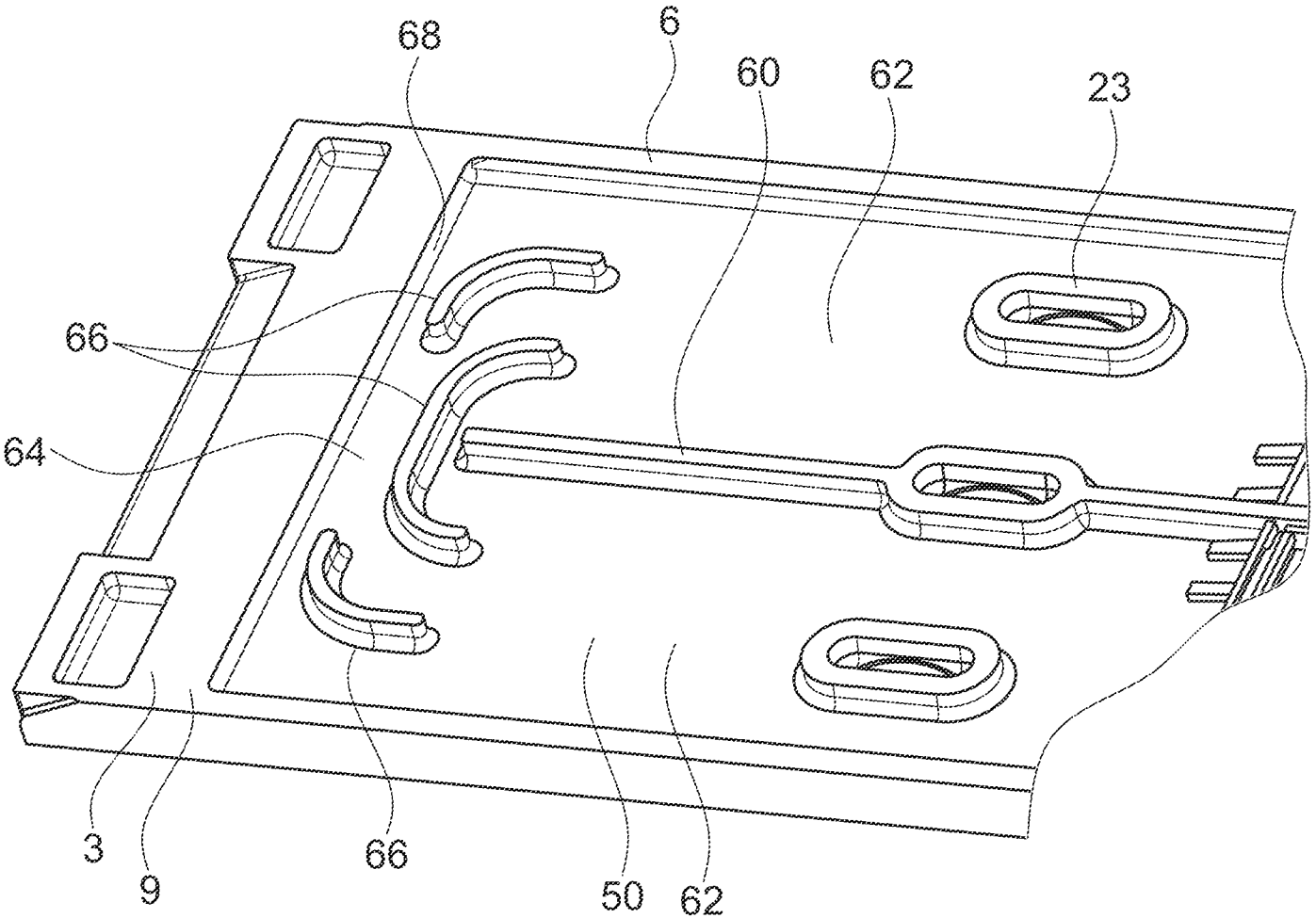
FIG. 3 shows a perspective view of an embodiment of the grate block from FIG. 1 with the planar hollow space from FIG. 2.

FIG. 3 shows a view from below of a section through the grate block 1 from FIG. 1 in connection with the planar hollow space 50 which is described in FIG. 2. The base plate 53, which delimits the hollow space 50, from FIG. 2 has been removed in this instance. The planar hollow space 50 comprises redirection elements 66 which redirect the fluid stream from the fluid supply line 52 (FIG. 2) to the fluid discharge line 54 (FIG. 2). FIG. 3 also clearly shows how the planar hollow space 50 in the rear region 9 of the block member 3 is delimited by the side walls 6 and the rear wall 68. FIG. 3 further clearly shows that the air supply openings 23 lead through the planar hollow space 50 from the upper wall.

FIGS. 4*a* and 4*b* show a longitudinal section along the longitudinal axis L through the front region of the block member from FIG. 1 with the air supply openings 21 in the front wall 15. It can further be seen that the dividing wall 60 which subdivides the hollow space 50 has an opening 70 which serves to ventilate the compartments 62 which are produced by the dividing wall 60. The supply opening 58 comprises in an opening region 72 which faces the hollow space 50 a distributor element 74 which is in the form of a boss-like or hill-like obstacle in this instance. The fluid stream which is directed via the supply opening 58 into the hollow space 50 is distributed by means of the distributor element 74 so that no turbulence which would lead to foam formation or air bubbles and therefore a reduced cooling power is formed inside the planar hollow space 50. The base 51 delimits the hollow space 50 in a downward direction. The base plate 53, which would adjoin the base in a longitudinal direction L, from FIG. 2 is not illustrated. The distributor element 74 could also be in the form of a transverse bar instead of the boss-like or hill-like obstacle (not illustrated).

FIG. 5 shows a cross section through the front wall 15 with the chambers 56 which are shown in FIG. 2 and in which the fluid supply line 52 or the fluid discharge line 54 opens. In this case, the cooling fluid flows through the fluid supply line 52 into the chamber 56 and becomes distributed over the supply openings 58 in the hollow space (not illustrated). The cooling fluid flows, after it has passed the hollow space, through the supply openings 58' into the chamber 56' and is discharged by the fluid discharge line 54 out of the block member 3. The fluid discharge line 54 can in this case be connected to an additional fluid supply line of an additional block member (not illustrated).

The illustrated block members have a length in the longitudinal direction L of from 400 to 800 mm, preferably from 500 to 750 mm and particularly preferably from 650 to 700 mm. The illustrated block members have a width in the width direction Q of from 280 to 500 mm, preferably from 320 to 460 mm and particularly preferably from 380 to 420 mm. The illustrated block members have a height of from 100 to 200 mm, preferably from 130 to 180 mm and particularly preferably from 150 to 160 mm. The block member is preferably made from low-alloy to high-alloy cast steel. In comparison with non-alloyed cast steel, low-alloy to high-alloy cast steel additionally contains in changing proportions alloy elements, such as chromium, nickel, molybdenum, vanadium, tungsten and the like. The block member is preferably produced by means of casting or injection casting methods. The supply openings preferably have a diameter of from 12 to 28 mm and particularly preferably a diameter of from 16 to 22 mm.

FIG. 6 shows a longitudinal section along the longitudinal axis L through the block member 3 from FIG. 1, wherein the distributor element is not illustrated in a front region 76 of the hollow space 50. The base 51 is in the form of an integral portion of the block member 3 and delimits together with the base plate 53 the hollow space 50 in a downward direction. Furthermore, the hollow space 50 is delimited by the rear wall 68 and the front wall 15. The base plate 53 has the air supply openings 21 in this case, similarly to the upper wall 5. The air supply openings 21 widen in this case from the upper wall 5 concentrically toward the base plate 53.

The invention claimed is:

1. A cooled grate block as part of a grate for an installation for thermally processing waste, wherein the grate blocks are arranged in a step-like manner one above the other and configured in such a manner in order to rearrange and convey combustion material during combustion via pushing movements which are carried out relative to each other, comprising a block member which is in the form of a cast component and which has an upper wall which forms an external support face which extends at least partially parallel with a longitudinal axis of the block member for the waste which is intended to be processed, a planar hollow space which is arranged directly under the support face for receiving a cooling fluid and which is delimited at the upper side by the upper wall, at the front by a front wall, at the bottom by a base, at the rear by a rear wall and laterally by side walls, wherein the base is at least partially formed by a base plate, a fluid supply line and a fluid discharge line which are connected to the hollow space, at least one redirection element which is arranged in the hollow space in order to redirect a cooling fluid in the hollow space from the fluid supply line to the fluid discharge line, and a distributor element, which is arranged in a front region of the hollow space, in order to distribute the fluid which is introduced through the fluid supply line into the hollow space.

2. The grate block as claimed in claim 1, wherein the distributor element extends at least partially along a width axis which extends at least approximately parallel with the front wall.

3. The grate block as claimed in claim 1, wherein the planar hollow space is connected to a front chamber which extends substantially parallel with the front wall and by which the cooling fluid supply to the planar hollow space or the cooling fluid discharge from the hollow space is brought about.

4. The grate block as claimed in claim 3, wherein the planar hollow space and the chamber are connected to each other via a plurality of supply openings.

5. The grate block as claimed in claim 4, wherein the distributor element is located in an opening region of at least one of the supply openings.

6. The grate block as claimed in claim 1, wherein the planar hollow space has a dividing wall which extends from the base to the upper wall and which extends from the front wall in the direction of the rear wall of the hollow space and which forms a passage in the region of the rear wall and which subdivides the hollow space into two compartments which are connected in a fluid-conducting manner.

7. The grate block as claimed in claim 6, wherein the dividing wall has an opening in the region of the front wall in order to ventilate the hollow space or the compartments which are produced by the dividing wall.

8. The grate block as claimed in claim 6, wherein the dividing wall extends at least approximately parallel with one of the side walls.

9. The grate block as claimed in claim 1, wherein the fluid supply line and the fluid discharge line are connected in the region of the front wall to the planar hollow space.

10. The grate block as claimed in claim 1, wherein the distributor element is in the form of a boss, aperture, perforated plate or transverse bar which extends at least approximately parallel with the front wall.

11. The grate block as claimed in claim 1, wherein the distributor element comprises a projection which limits or redirects the flow of the cooling fluid out of the fluid supply line.

12. The grate block as claimed in claim 1, wherein the distributor element is constructed so that it allows only a limited throughflow of cooling fluid past the distributor element in order to allow a uniform distribution of the cooling fluid inside the hollow space.

13. The grate block as claimed in claim 1, wherein the upper wall and/or the front wall has at least one air supply opening.

14. The grate block as claimed in claim 1, wherein the block member is produced integrally as a cast component and the base plate is welded to the block member in order to delimit the hollow space.

15. The grate block as claimed in claim 1, wherein the hollow space extends over at least ⅔ of the length and/or over at least ¾ of the width of the support face.

16. A grate comprising a plurality of grate blocks as claimed in claim 1.

* * * * *